United States Patent [19]

Hamilton

[11] 4,431,402

[45] Feb. 14, 1984

[54] WASTE GAS FLARE IGNITER

[76] Inventor: Louis F. Hamilton, Rte. 5 - Box 192, S. Airport Rd., Weatherford, Okla. 73906

[21] Appl. No.: 369,972

[22] Filed: Apr. 19, 1982

[51] Int. Cl.[3] ..... F23D 13/20

[52] U.S. Cl. ..... 431/23; 431/87; 431/202; 431/264; 431/279

[58] Field of Search ..... 431/202, 279, 283, 284, 431/264, 266, 86, 87, 23

[56] References Cited

U.S. PATENT DOCUMENTS

| | | | |
|---|---|---|---|
| 2,661,798 | 12/1953 | Clevenger . | |
| 2,734,562 | 2/1956 | Haberle et al. . | |
| 2,968,349 | 1/1961 | Reichelderfer | 431/265 |
| 3,622,258 | 11/1971 | Goto . | |
| 3,914,088 | 10/1975 | Huyck . | |
| 3,914,094 | 10/1975 | Landry . | |
| 4,025,281 | 5/1977 | Lapp . | |
| 4,139,339 | 2/1979 | Straitz . | |
| 4,198,198 | 4/1980 | Straitz . | |

*Primary Examiner*—Carroll B. Dority, Jr.
*Attorney, Agent, or Firm*—Litman, Day & McMahon

[57] ABSTRACT

A waste gas flare igniter includes a pair of ignition tubes, each having a fuel line and an electrode extending therethrough to points near the ends of the tubes. The tubes are connected to an air distribution box which is slidably mounted on linear guides. A jackscrew and motor translate the air box and tubes between an extended position wherein the tubes connect with inwardly directed extensions passing through a heat shield at the end of the flare pipe for ignition of the waste gas and a retracted position spacing the tubes from the heat shield. The air box is connected by a telescoping duct to a blower, and the fuel line to a valve and pump to provide a fuel-air mixture which is ignited when the tubes are extended to ignite the waste gas.

17 Claims, 8 Drawing Figures

8
23
21
30
25
109
94'
95'
94
108
95
18
19
2
32
34
35
31
29
33
51
36
16
12
70
77
66
69
14
15
10
11

WASTE GAS FLARE IGNITER

FIELD OF THE INVENTION

The present invention relates to arrangements for igniting combustible waste gases and, more particularly, to such an arrangement having operative parts protected from the adverse effects of heat from the burning gas.

BACKGROUND OF THE INVENTION

Natural gas or methane often occurs in conjunction with deposits of petroleum. When such gas occurs in quantities which are too small for economical transportation to a point of use, the gas is considered "waste gas" and is disposed of in the most convenient manner. In earlier times the gas was simply vented into the atmosphere. In the present, however, safety regulations generally require the waste gas to be burned or flared to prevent fire and explosion hazards. Ignition of the gas may be hazardous because of the inability of the operator to detect the gas or its rate of escape. Thus, large quantities of the gas may be present, which could ignite explosively.

In oil drilling operations, the natural gas becomes mixed with the packing mud in the drill hole. The mud is passed through a mud-gas separator; and thereafter, the major portion of the mud recirculated to the drill hole while the gas is expelled through a flare pipe. Salt water or brine is often encountered in conjunction with oil deposits, and the water, along with a portion of the mud, is drained into a sludge pit. The flare pipe is often used for draining the water, and commonly extends horizontally from the drilling rig to the sludge pit, usually a distance of several hundred feet. In contrast, flare arrangements in refineries and chemical plants are usually oriented vertically because of space limitations.

Heretofore, methods of igniting the waste gas included shooting flaming arrows, tracer bullets, or signal type flares through the gas emanating from the flare pipe. These practices are unreliable and often dangerous to humans or livestock. Another method of igniting the gas is burning an open container of liquid fuel, such as diesel fuel, near the flare pipe outlet. However, the diesel fuel fire is often extinguished by wind or rain, and reignition of the fuel in the possible presence of the gas is extremely hazardous. In a further flare ignition method, the gas is ignited by an electric spark from an automobile spark coil, electric fence charger, or similar type of transformer. However, the electrode elements, being placed directly in the stream of burning gas, are often burned beyond further use. Additionally, the transformers are often damaged either by the radiant heat of the gas flame or by the flame itself being blown back toward the transformer by wind.

Many arrangements have been devised for the ignition of combustible gases vented through vertical flare stacks. Since the majority of vertical flare stacks are associated with fixed industrial plants, the ignition arrangements are often complex and not suited to periodic dismantling, moving, and reassembly as is often the requirement in oil drilling operations. Further, vertical flare igniters often depend for operation on the convective propogation of the flame front within a vertical tube for the ignition of the waste gas. Such an arrangement would not be suitable to ignite waste gas from a horizontal flare pipe, such horizontal flares positioned generally close to the ground.

SUMMARY OF THE INVENTION

The present invention provides a waste gas flare igniter which is particularly suited for igniting waste gas from a horizontal flare pipe and which, could be suitably adapted for the ignition of vertical flares. The igniter arrangement of the present invention is generally a movable pilot structure which burns a stored fuel for a selected time interval in order to ignite the waste gas. The arrangement includes a heat shield behind which the operative portions of the arrangement are withdrawn after ignition of the waste gas for protection from the heat of the burning waste gas and to retard the conduction of heat from the heat shield.

OBJECTS OF THE INVENTION

The principal objects of the present invention are: to provide a waste gas flare ignition arrangement; to provide such an arrangement for directing a flame toward a stream of combustible waste gas issuing from the outlet end of a flare pipe to ignite same; to provide such an arrangement for use particularly with a horizontally extending flare pipe associated with an oil drilling rig; to provide such an arrangement including an ignition tube having a fuel line and electrodes extending therethrough respectively to a fuel nozzle and a spark gap at the end of the tube, the ignition tube receiving air from a blower to thereby provide a fuel-air mixture and a spark to ignite same; to provide such an arrangement including a heat shield mounted at the end of the flare pipe, a translatable support for the ignition tube, and a motor to move the support between an extended position with the outlet end of the ignition tube extending through the heat shield for ignition of the waste gas and a retracted position behind the heat shield for protection of the arrangement from the heat of the waste gas flame; to provide such an arrangement including a control system for coordinating the operation of the motor, the blower, a fuel pump, a fuel valve, and a high voltage transformer connected to the electrodes; to provide such an arrangement including a secondary or backup ignition tube with duplicate controls therefor; to provide such an arrangement including a thermostat connected to the blower and operative to activate the blower in response to excessive temperature within a distribution enclosure connecting the ignition tubes with the blower and also housing the transformers and fuel valves in order to cool same; to provide such an arrangement which substantially increases the safety of the ignition and burning of waste gases encountered in oil drilling operations; and to provide such an arrangement which is economical to manufacture, positive in operation and which is particularly well adapted for its intended purpose.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figures 1, 2:
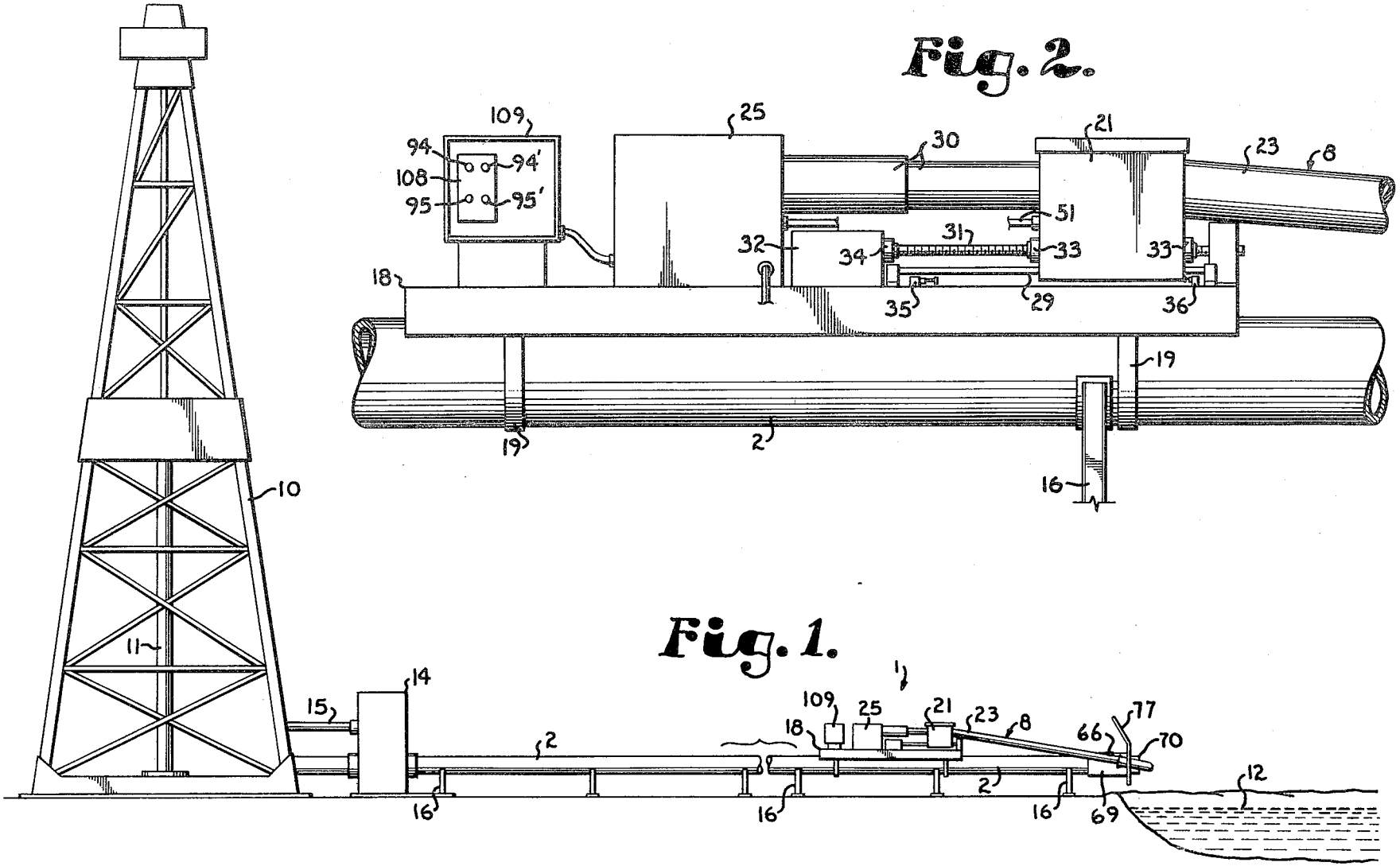
FIG. 1 is a side elevational view at a reduced scale showing a waste gas flare igniter embodying the present invention and positioned at the end of a horizontal flare pipe extending from a drilling rig to a sludge pit.
FIG. 2 is an enlarged, fragmentary side elevational view of the igniter illustrating a translatable air distribution enclosure providing communication between a blower and ignition tubes.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an igniter arrangement for igniting combustible waste gas vented through a waste gas flare pipe 2. The igniter arrangement 1 generally includes a fuel supply system 3, an air supply system 4, and a spark generating system 5 cooperating with a translatable pilot structure 8 to direct a flaming jet toward a stream of waste gas issuing from the flare pipe 2 to ignite the gas.

In the example of use shown in FIG. 1, the flare pipe 2 is associated with an oil drilling rig 10, although the igniter arrangement 1 could be used with industrial stacks. In drilling operations, special muds are used for various purposes, including packing of the bore hole to prevent a "blowout", lubrication and cooling of the drill bit, and removal of material ground away by the bit. The drilling mud is circulated down the drill string 11 to the bit (not shown) and out the bore hole. As the mud is circulated through the bore hole, natural gas and water, generally salt water, when present, become mixed with the mud. The water is drained off through the flare pipe 2, often carrying a minor portion of the drilling mud, and deposited in a sludge pit 12. The gas is separated from the mud in a mud-gas separator 14. The mud is recirculated to the bore hole by means of a conduit 15, and the gas is vented through the flare pipe 2. Since the pipe 2 in drilling operation is often used to drain off the water encountered, the flare pipe 2 is oriented horizontally and generally extends several hundred feet from the rig 10 in order to provide a safe location for burning of the gas. The flare pipe 2 is supported relatively close to the ground by legs 16.

The operative components of the igniter arrangement 1 are supported on a stationary support or platform 18 which may be positioned above or below the flare pipe 2. As illustrated, the platform 18 is positioned on the flare pipe 2 by means such as straps 19. The translatable pilot structure 8 is supported principally by the platform 18 as are the fuel supply system 3, the air supply system 4, and the spark generating system 5.

Figure 3:
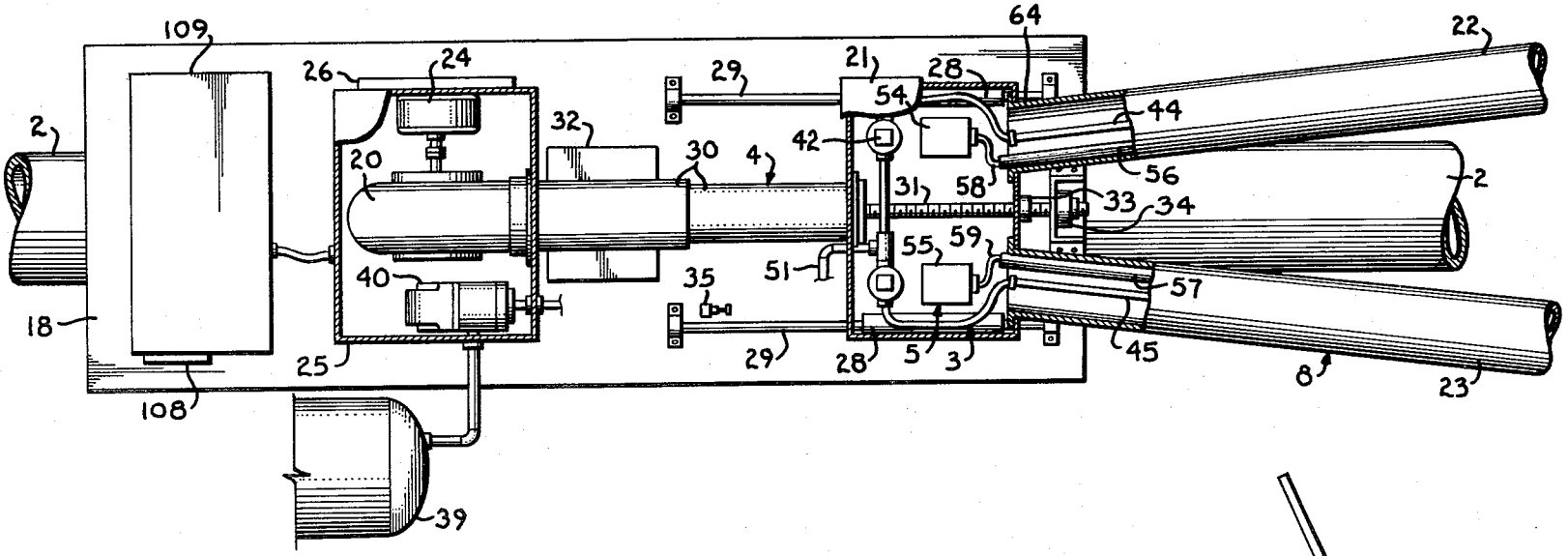
FIG. 3 is an enlarged fragmentary top plan view of the igniter arrangement illustrating internal details.
Figure 4:
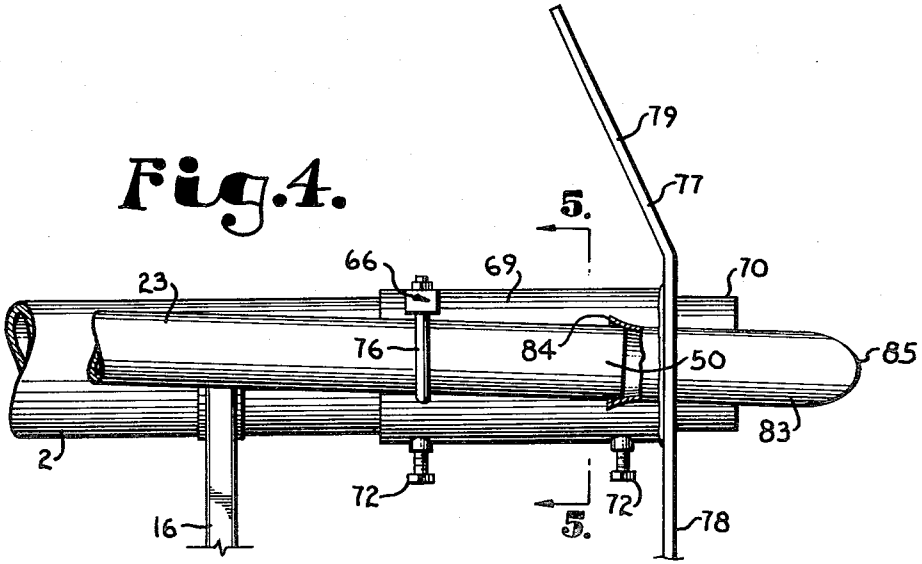
FIG. 4 is an enlarged, fragmentary side elevational view of the outlet ends of the waste gas flare pipe and ignition tubes.
Figure 5:
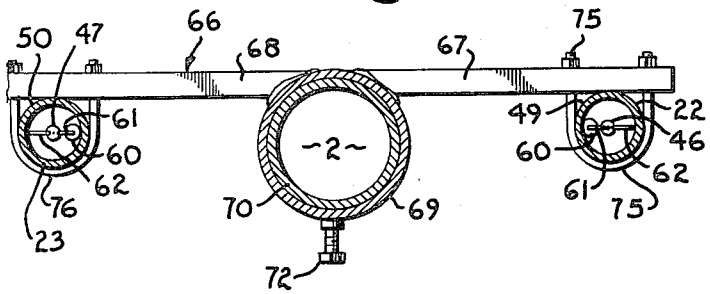
FIG. 5 is a fragmentary cross-sectional view taken on line 5—5 of FIG. 4 and illustrates details of the ignition tube guides.

Referring particularly to FIGS. 2 and 3, the air supply system 4 includes a blower 20 communicating with an air distribution enclosure or air box 21 which in turn communicates with a pair of air tubes or ignition tubes 22 and 23. The illustrated blower 20 is a centrifugal type fan which is driven by a blower motor 24. The blower 20 and motor 24 are positioned in a housing 25 to protect same from sun, rain, dust and the like. The air supply system 4 receives air through an opening (not shown) in one of the walls of the housing 25 which is preferably covered by a filter or screen 26.

The air distribution enclosure 21 is supported in any convenient manner for translation along the flare pipe 2. The illustrated air box 21 has slide bearings 28 positioned thereon or therein (FIG. 3) which receive guide rods 29 therethrough. The guide rods 29 are mounted on the platform 18 and run generally parallel to the flare pipe 2. The movable air box 21 communicates with the stationary blower 20 by means of a telescoping duct 30. The enclosure 21 is translated by means of a threaded jackscrew 31 attached to the jackscrew motor 32 and engaging threaded bearings or nuts 33 affixed to the enclosure 21. Preferably, the threads on the jackscrew 31 and nuts 33 are square profile threads such as Acme threads. The jackscrew 31 is supported by and extends between a pair of jackscrew bearings 34. Upon rotation of a jackscrew 31, the enclosure 21 is translated in a direction parallel to the flare pipe 2. The excursion of the air box 21 during extension and retraction is limited by means of a rear or first limit switch 35 and a front or second limit switch 36 which are interconnected with the jackscrew motor 32. The limit switches 35 and 36 are configured to allow for a small amount of overtravel of the enclosure 21 because of inertia after operation of one of the switches. The switches 35 and 36 may be mounted either on the enclosure 21 or, as illustrated, on the platform 18.

In the illustrated example, the fuel supply system 3, FIG. 3, includes a fuel tank 39, a high pressure fuel pump 40, a pair of solenoid actuated fuel valves 42 and 43, and a pair of fuel lines 44 and 45 terminating respectively in fuel nozzles 46 and 47. The fuel lines 44 and 45 extend respectively through the ignition tubes 22 and 23, the nozzles 46 and 47 being positioned near the respective outlet ends 49 and 50 of the tubes 22 and 23. A flexible fuel line 51 with slack to accommodate extension and retraction of the ignition extends between the fuel pump 40, located in the housing 25, and the valves 42 and 43 which are located in the movable enclosure 21. The valves 42 and 43 are controlled in such a manner that only one is open at a time, thereby delivering fuel to a single selected fuel nozzle 46 or 47.

The preferred fuel for igniting the waste gas is diesel fuel for economy and safety. Under some circumstances, it might be desirable to employ other liquid fuels such as kerosene, propane, or the like. Another alternative would be to compress and store a quantity of the waste gas for igniting subsequent quantities thereof. Slight modifications would be required in the fuel system 3 depending on the type of fuel employed therein. However, such modifications are considered to be within the scope of this invention.

The spark generating system 5 includes a pair of high voltage transformers 54 and 55 connected respectively to a pair of electrode assemblies 56 and 57 positioned respectively in the ignition tubes 22 and 23. In the illustrated arrangement 1, each electrode assembly includes a single insulated conductor 58 or 59 extending through the associated ignition tube and constituting a hot conductor while the ignition tube constitutes the common or ground conductor. Each electrode conductor is insulated from its associated ignition tube by means of a ceramic insulator 60 extending the length of the conductor. In the illustrated arrangement, the insulator 60 has a radius of about one-half inch and, further, is encased in a metal tube. The insulator 60 prevents arcing at undesired locations.

Each of the electrode assemblies 56 and 57 terminates in a pair of spaced electrodes 61 and 62, defining a spark gap which is preferably positioned in relation to the associated fuel nozzle 46 or 47 for passage of a stream of fuel therethrough. The electrode 61 is an extension of the associated electrode conductor 58 or 59, and the electrode conductor 62 is connected to the associated ignition tube 22 or 23. The electrodes 61 and 62 are desirably constructed of a metal which resists deterioration in the presence of high voltages and heat generated upon ignition of the fuel. The transformers 54 and 55 are controlled in such that only one transformer is activated at a time and such that the operation of each transformer is coordinated with the fuel valve 42 or 43 which controls fuel flow in the ignition tube associated therewith. Upon activation of each transformer, an electric spark is discharged across the spark gap defined by the electrodes.

The respective inlet ends 64 and 65 of ignition tubes 22 and 23 are attached to and supported by the enclosure 21. The outlet ends 49 and 50 are slidably supported by a guide assembly 66. The illustrated guide assembly includes support arms 67 and 68 extending outwardly from a sleeve 69 received on the outlet end 70 of the flare pipe 2. The arms 67 and 68 may be a single member or separate members attached, as by welding, to the sleeve 69. The sleeve 69 is positioned on the pipe 2 by means of set bolts 72. The arms 67 and 68 support hangers such as U-bolts 75 and 76 which slidably receive the respective ignition tubes 22 and 23.

The sleeve 69 additionally provides a support for a heat shield 77. The exemplary heat shield 77 is generally planar and includes a substantially vertical shield section 78 and an angled shield section 79 inclined away from the end 70 of the flare pipe 2. The heat shield 77 extends above, below, and to either side of the flare pipe 2 in order to shield the tubes 22 and 23 and other portions of the arrangement from a major portion of the heat radiated from the burning gas. The heat shield also serves to some extent as a heat sink because of its surface area to dissipate conducted heat.

Figure 6:
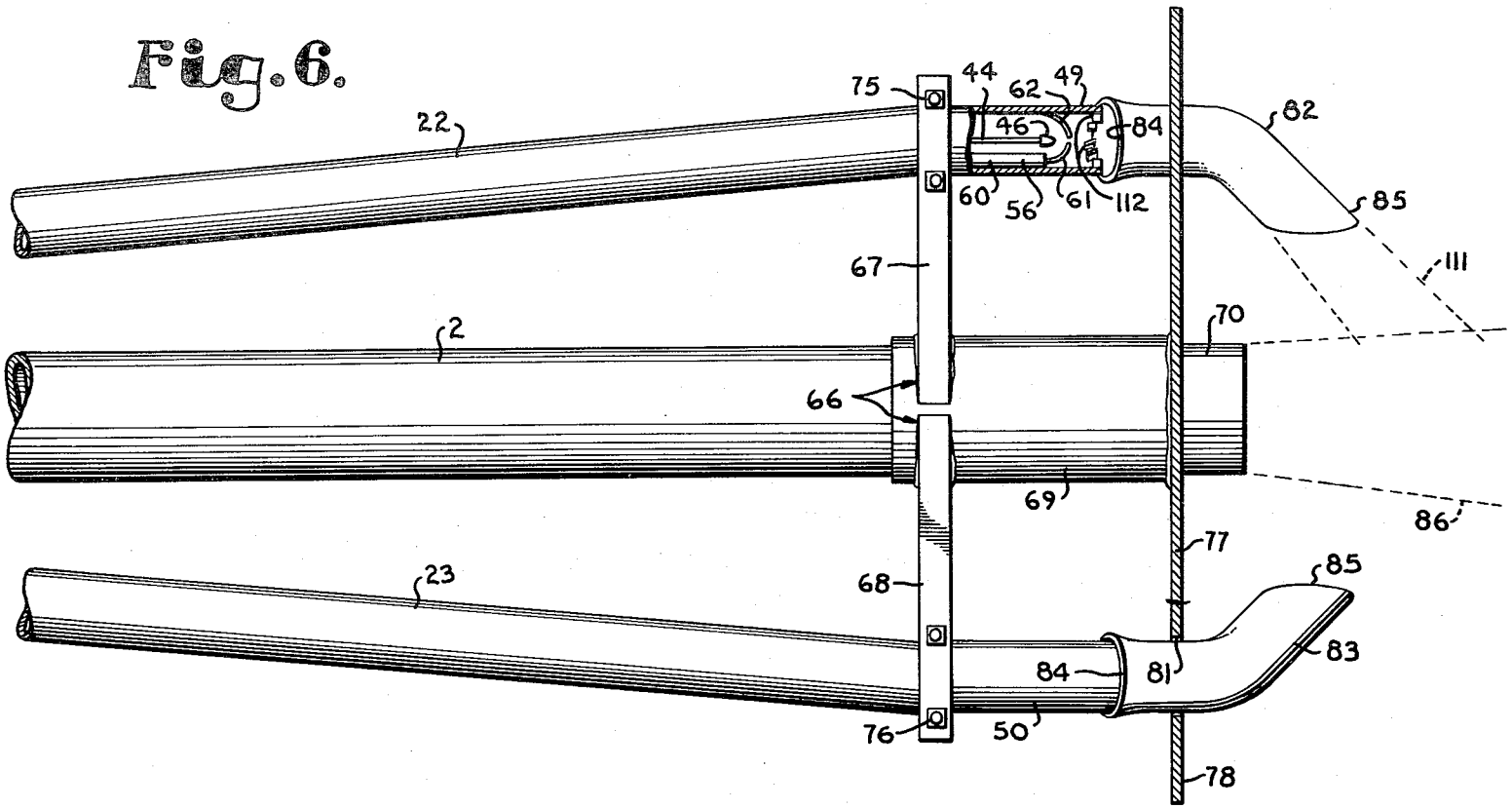
FIG. 6 is an enlarged, fragmentary top plan view of the outlet ends of the flare pipe and ignition tubes.

The heat shield 77 has apertures 81 through which are mounted angled extensions 82 and 83 of the respective ignition tubes 22 and 23. The extensions 82 and 83 are positioned for registry and communication with the respective ignition tubes as the tubes travel forwardly. The extensions are preferably flared at inlet ends 84 thereof while the outlet ends 85 thereof are directed toward the stream 86 (FIG. 6) of waste gas.

Figure 8:
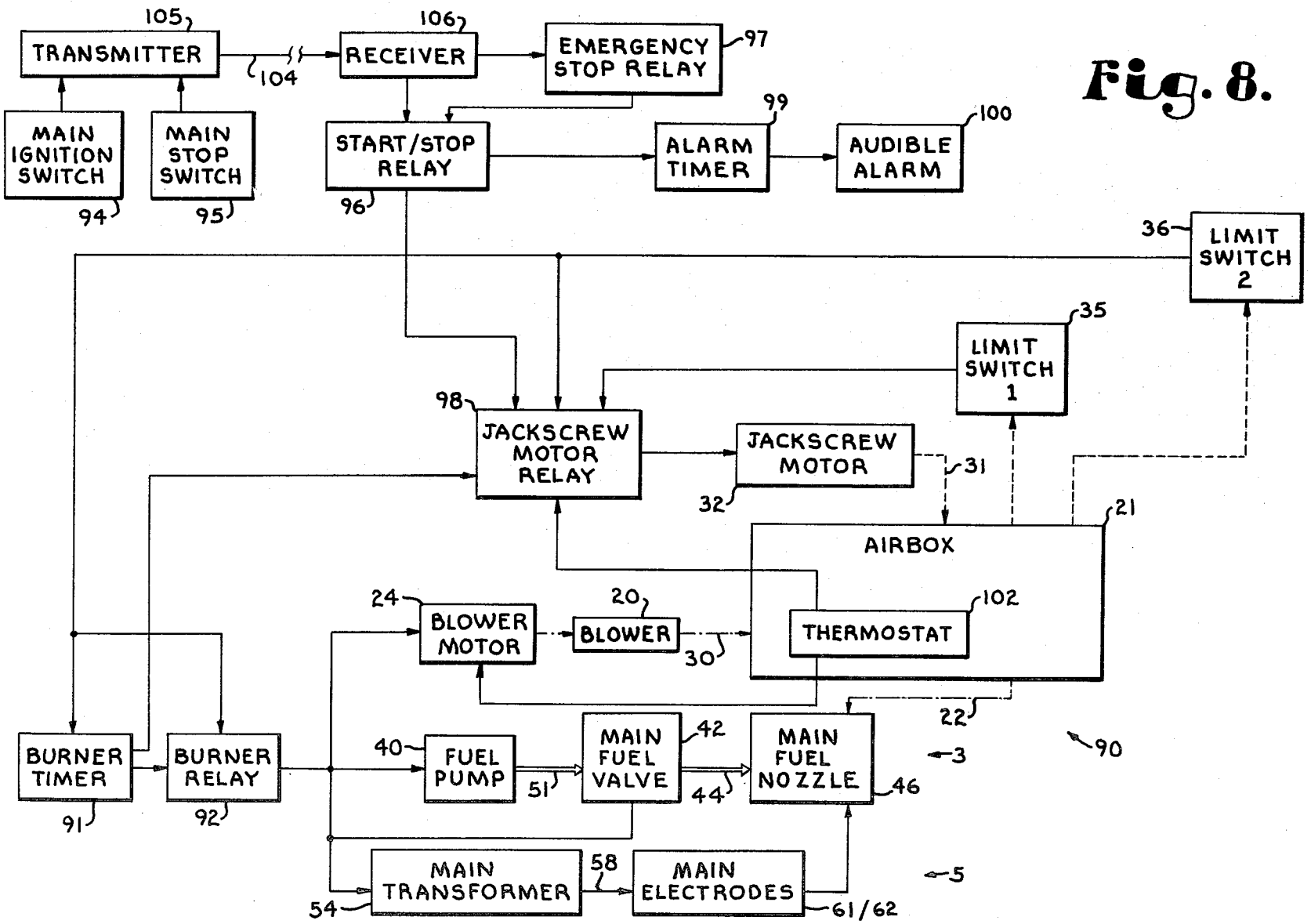
FIG. 8 is a block diagram illustrating the controls for the igniter arrangement.

A portion of the control system 90 for the arrangement 1 is illustrated in FIG. 8 and has electrical conductors, such as the electrode conductor 58, represented as solid lines. Mechanical connections and responses, such as the jackscrew 31, are represented as dashed lines. Air flow interrelationships, such as the telescoping duct 30, are represented as long and short dashed lines. Fuel lines, such as the fuel line 44, are drawn as solid double lines. The portions of the control system 90 which are common to both of the ignition tubes and the portions which relate specifically to the ignition tube 22 are illustrated in FIG. 8. The portions relating specifically to the ignition tube 23 have been omitted for clarity, but are substantially duplicates of those relating to the tube 22.

Preferably, only one ignition tube is activated at a time for ignition of the waste gas. The ignition tube 22 is considered the primary tube, and the tube 23 is considered as the secondary or backup tube. Ordinarily, only the primary tube 22 is employed to ignite the stream of waste gas and the secondary tube 23 is employed in the event of malfunction or to allow for cooling of the primary tube 22. However, the control system 90 is set up so that either tube 22 or 23 could be employed. The ignition tube 22 is fired for a selected time interval and is controlled by a burner timer 91 acting through a burner relay 92 having sets of contacts (not shown) connected to the blower motor 24, the fuel pump 40 and valve 42, and the transformer 54.

The control system 90 includes a main ignition switch 94 and a main stop switch 95 operable to effect respectively the ignition of a fuel-air mixture from the main ignition tube 22 and extinguishing. The secondary ignition switch 94' and the secondary stop switch 95' (FIG. 2) are also provided for igniting and extinguishing the secondary ignition tube 23. The ignition switch 94 causes a start/stop relay 96 to be activated while the stop switch 95 deactivates the relay 96 by way of an emergency stop relay 97. The start/stop relay 96 is connected to a jackscrew motor relay 98 and an alarm timer 99. The relay 98 controls the operation of the jackscrew motor 32 while the alarm timer 99 is connected to and controls operation of an audible, preferably loud, alarm device 100. The jackscrew motor relay 98 receives control inputs from the limit switches 35 and 36, from a thermostatic element or thermostat 102 which is located in the enclosure 21, and from the burner timer 91.

The ignition switch 94 could be connected directly to the start/stop relay 96 and the stop switch 95 to the emergency stop relay 97. However, a radio link 104 is preferably provided therebetween to provide an extra margin of safety and for increased flexibility of operation. The radio link 104 includes a transmitter 105 having the switches 94 and 95 connected thereto and a receiver 106 having the relays 96 and 97 connected thereto. The transmitter 105 and receiver 106 may be similar to radio arrangements used for detonating blasting charges. In such arrangements, a coded digitally modulated signal is employed. In the transmitter 105 and receiver 106, a unique code is employed for each of the main ignition switch 94 and secondary ignition switch 94'. A third code may be employed for both of the main and secodary stop switches 95 and 95', or separate codes may be provided for the stop switches depending upon the exact configuration of the control system 92.

The transmitter 105 may be a portable unit or may be fixed and located on the drill rig 10 or in a building or trailer near the rig. Moreover, switches 94, 94', 95, and 95' may be provided on a control panel 108 located on a control enclosure 109 FIG. 2 which houses the relays and timers of the control system 90. The housing 109 is positioned on the platform 18, and the receiver 106 may be housed in the enclosure 109 if the control system 90 includes the radio link 104. It would also be possible for the arrangement 1 to be controlled automatically in response to the sensing of gas in the flare pipe 2 or in the bore hole by means of a gas senser (not shown).

In normal operation, when the presence of gas in flare pipe 2 is known or sensed, either by the sound of gas coursing through the pipes or by a gas sensor, the main ignition switch 94 is operated to ignite the primary ignition tube 22. Operation of the main ignition switch 94 causes the transmitter 105 to transmit a unique code which is received by the receiver 106 thereby causing the start/stop relay 96 to be energized. Upon operation of the relay 96, the alarm timer 99 is activated to sound the alarm 100 in the area of the outlet end 70 of the flare pipe 2 in order to advise workmen in the area to stand clear. Simultaneously, the jackscrew motor relay 98 is energized to cause the jackscrew motor 32 to operate in a forward direction and move the enclosure 21 toward the extended position, FIG. 6. As the enclosure 21 is extended, the ignition tubes 22 and 23 move into registry with the respective ignition tube extensions 82 and 83. As the enclosure 21 reaches the extended position, the forward limit switch 36 causes the relay 98 to cease operation of the motor 32 and initiates the burner timer 91. By this time, the alarm timer 99 has timed out to cease the alarm. The timer 91 actuates the burner relay 92 which: activates the blower motor 24 to rotate the blower 20 thereby delivering air through the enclosure 21 and ignition tubes 22 and 23; opens the main fuel valve 42 and activates the fuel pump 40 to deliver fuel through the main fuel nozzle 46; and connects the main transformer 54 to a source of electrical power to thereby generate a spark across the main electrodes 61/62 to ignite the fuel air mixture thereby developing a pilot flame 111 (FIG. 6) to ignite the stream of gas 86 exiting the outlet 70 of the flare pipe. Preferably, the ignition tubes 22 and 23 include a blade arrangement 112 at the ends respectively 49 and 50 to promote the mixture of fuel and air. The blades 112 may be arranged in a helical manner to cause swirling of the fuel and air to promote more complete combustion thereof and to develop a pilot flame 111 of sufficient length.

Figure 7:
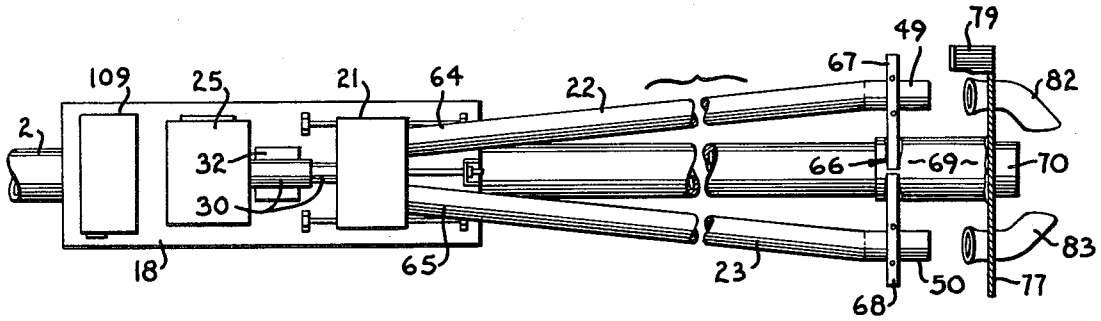
FIG. 7 is a top plan view at a reduced scale of the waste gas flare igniter arrangement.

The burner timer 91 may be set to provide burning for several minutes to several hours. When the timer 91 times out, the timer 91 causes the motor relay 98 to reverse the rotation of the motor 32 thereby translating the enclosure 21 toward the retracted position, FIG. 7. As soon as the enclosure 21 moves out of contact with the forward limit switch 36, the burner relay 92 is deactivated, thereby shutting down the fuel supply system 3 and spark generating system 5. The air supply system 4 is wired independently to the thermostat 102 and continues to operate as long as the temperature in the enclosure 21 exceeds the set temperature of the thermostat 102. The motor 32 continues to operate in the reverse direction until the enclosure 21 engages the rear limit switch 35 whereby the motor 32 is deactivated through the motor relay 98. The stream 86 of waste gas continues to burn until exhausted. The retraction of the ignition structure 8 reduces the transfer of heat to prevent undesired fuel overheating in the fuel lines 44 and 45 and further reduces deterioration of components of the arrangement 1 due to excess heat. Further heat reduction is provided by the heat shield 77. Should an overheated condition develop within the enclosure 21 while in the extended position, the thermostat 102 would actuate the motor relay 98 to cause retraction of the ignition structure 8 and shut down of the fuel and spark; however, operation of the blower 20 continues until the temperature within the enclosure 21 has been reduced.

If an emergency situation were to occur requiring extinguishing the pilot flame 111, the main stop switch 95 would be operated whereby the transmitter 105 transmits a stop code to the receiver 106 to deactivate the start/stop relay 96 through the emergency stop relay 97. In this circumstance, the motor relay 98 causes the motor 32 to operate in a reverse direction to retract the enclosure 21 and shut down of the fuel system 3 and spark generating system 5 in the manner explained above.

After the main ignition tube 22 has been extended, ignited, extinguished, and retracted; the cycle may be repeated with the main ignition tube 22 or the secondary ignition tube 23 may be employed to allow cooling of the main ignition tube 22. Further, should a malfunction occur during operation of the main ignition tube 22, the main stop switch 95 may be operated and after the ignition structure 8 is returned to the retracted position, the secondary ignition tube may be ignited by operation of the secondary ignition switch 94'. The secondary ignition tube 23 is extended, ignited, extinguished, and retracted in substantially the same manner as described in connection with the main ignition tube 22.

It is to be understood that while certain forms of the present invention have been illustrated and described herein, it is not to be limited to the specific forms or arrangement of parts described and shown.

What is claimed and desired to secure by Letters Patent is:

1. A waste gas flare ignition arrangement for use to ignite combustible waste gas issuing from a flare pipe and comprising:

(a) fuel delivery means including a source of fuel for ignition of said waste gas and terminating in a fuel nozzle;

(b) spark generating means including electrode means defining a spark gap spaced from said nozzle;

(c) translatable support means supporting said fuel nozzle and said electrode means in one of a first extended position for directing a flaming mixture of fuel from said nozzle toward waste gas issuing from an outlet end of a waste gas flare pipe and a second retracted position spaced along said flare pipe from said outlet end;

(d) motor means mechanically connected to said support means and operable to translate said support means between said positions; and (e) control means connected to said fuel delivery means, said spark generating means, and said motor means and selectively operable to effect the translation of said support means, the delivery of said fuel through said nozzle, and the generation of a spark across said spark gap to ignite said fuel to ignite said waste gas.

2. The arrangement set forth in claim 1 including:

(a) ignition tube means attached to said support means;

(b) a blower communicating with said ignition tube means to supply air for mixture with said fuel to support the combustion of same and cooling components within said ignition tube means;

(c) said fuel delivery means including a fuel line connected to said nozzle, said nozzle and a portion of said fuel line being positioned in said ignition tube means; and (d) said electrode means being positioned in said ignition tube means.

3. The arrangement set forth in claim 2 wherein:

(a) said ignition tube means is a primary ignition tube means; and (b) said arrangement includes a secondary ignition tube means positioned in spaced relation to said primary tube means, said secondary tube means being substantially identical to said primary ignition tube means.

4. The arrangement set forth in claim 2 wherein:

(a) said blower is positioned on a stationary support; and (b) a telescoping duct provides communication between said blower and said ignition tube means.

5. The arrangement set forth in claim 2 including guide means positioned adjacent said outlet end of said flare pipe and slidably engaging said ignition tube means to guide same during translation thereof between said positions.

6. The arrangement set forth in claim 2 including:

(a) a heat shield positioned at said outlet end of said flare pipe to protect portions of said arrangement from ill effects of heat radiated from the burning of said waste gas;

(b) an ignition tube extension supported by and extending through said heat shield means and positioned for communication with said ignition tube means in said extended position of said support means, said extension being shaped to direct an ignited pilot flame toward a stream of said waste gas to ignite same; and (c) guide means positioned adjacent said outlet end of said flare pipe and slidably engaging said ignition tube means to support said tube means in said retracted position of said translatable support means and guiding said tube means into said communication with said tube extension in said extended position of said support means.

7. The arrangement set forth in claim 2 including:

(a) transformer means connected to said electrode means and operable to supply high voltage thereto;

(b) a controlled fuel valve connected in said fuel line;

(c) a fuel pump connected between said fuel valve and a source of said fuel;

(d) relay means having contacts connected to and controlling the operation of said transformer means, said fuel pump and fuel valve, said blower, and said motor means; and (e) timer means connected to said relay means and operable to effect for a selected time interval the activation of said motor means to translate said support means and said ignition tube means to said extended position, the activation of said blower to deliver air through said ignition tube means, the activation of said fuel pump and opening of said fuel valve to deliver fuel through said fuel nozzle, and the activation of said transformer means to provide high voltage to said spark gap to ignite a pilot flame to thereby ignite said waste gas.

8. The arrangement set forth in claim 2 wherein said translatable support means is an air distribution enclosure interposed between said blower and said ignition tube means and providing communication therebetween.

9. The arrangement set forth in claim 2 wherein:

(a) said ignition tube means is a primary ignition tube means;

(b) said arrangement includes a secondary ignition tube means positioned in spaced apart relation to said primary tube means, said secondary tube means being substantially identical to said primary ignition tube means; and (c) said translatable support means is an air distribution enclosure interposed between said blower and said primary and secondary ignition tube means and providing communication thereamong.

10. The arrangement set forth in claim 2 including temperature sensor means positioned to operatively sense the temperature within said ignition tube means and connected to said control means to cause operation of said blower and translation of said translatable support means to said retracted position upon said temperature within said ignition tube means exceeding a selected level.

11. The arrangement set forth in claim 1 including:

(a) thread means on said translatable support means; and (b) a jackscrew connected to said motor means, engaging said thread means, and operative to translate said support means upon rotation of said jackscrew.

12. The arrangement set forth in claim 1 wherein said control means includes timer means operative to effect for a selected time interval said translation of said support means to said extended position, said delivery of said fuel, and said generation of said spark.

13. A waste gas flare ignition arrangement for use to ignite combustible waste gas issuing from a waste gas flare pipe and comprising:

(a) ignition tube means supported along an outlet end of a waste gas flare pipe extending from a source of waste gas, said ignition tube means terminating in an ignition tube end;

(b) a blower communicating with said ignition tube means and operable to deliver air therethrough;

(c) fuel delivery means including a fuel line extending through said ignition tube means and terminating in a fuel nozzle adjacent said ignition tube end, said fuel delivery means selectively delivering fuel through said fuel nozzle;

(d) spark generating means including electrode means positioned in said ignition tube means, defining a spark gap spaced from said fuel nozzle, and selectively connected to a high voltage source to generate a spark across said gap;

(e) translatable support means supporting said ignition tube means in one of a first extended position to ignite said waste gas and a second retracted position spaced from said flare pipe end;

(f) motor means engaging said support means to translate same between said positions; and (g) control means connected to said blower means, said fuel delivery means, said electrode means, and said motor means and selectively operable to effect the translation of said support means, the delivery of air through said ignition tube means and fuel through said fuel nozzle, and the generation of a spark across said spark gap to ignite a pilot flame to thereby ignite said waste gas.

14. A waste gas flare ignition arrangement for use to ignite combustible waste gas issuing from a substantially horizontal waste gas flare pipe and comprising:

(a) an air flow tube;

(b) an air supply means communicating with said air flow tube and operable to force air therethrough;

(c) a fuel line extending through said air tube and terminating in a fuel nozzle;

(d) a fuel delivery means operable to deliver fuel under pressure through said fuel line and fuel nozzle;

(e) a pair of electrodes positioned within said air tube and defining a spark gap through which fuel from said fuel nozzle sprays;

(f) a high voltage supply selectively connected to said electrodes;

(g) support means positioning said air tube to direct a mixture of fuel and air toward a stream of waste gas issuing from a substantially horizontally oriented flare pipe;

(h) control means connected to said air supply means, said fuel delivery means, and said high voltage supply and selectively operable to force air through said air tube, to deliver fuel through said nozzle, and to generate a spark across said spark gap to ignite a pilot flame of said fuel and air and thereby ignite said waste gas;

(i) a temperature sensor positioned to operatively sense the temperature within said air tube; and said temperature sensor being connected to said control means and operative to cause said air supply means to force air through said air tube to cool same in response to said temperature within said air tube exceeding a selected level.

15. The arrangement set forth in claim 14 including:

(a) said support means being mounted for translation along said flare pipe between an extended position toward an outlet end of said flare pipe for ignition of said waste gas and a retracted position spaced away from said outlet end;

(b) motor means engaging said support means and operable to translate same between said positions;

(c) said control means being connected to said motor means to control the translation of said support means, said control means causing said motor means to translate said support means to said retracted position upon said temperature sensor sensing a temperature in excess of said selected level.

16. The arrangement set forth in claim 15 including:

(a) a heat shield positioned adjacent said outlet end of said flare pipe;

(b) an air tube extension extending through said heat shield and positioned for communication with said air tube in said extended position of said support means, said extension being shaped to direct said pilot flame toward a stream of said waste gas to ignite same; and (c) guide means positioned adjacent said outlet end of said flare pipe and slidably engaging said air tube to support same in said retracted position of said support means and guiding said air tube into said communication with said extension in said extended position of said support means.

17. A waste gas flare ignition arrangement comprising:

(a) an elongated waste gas flare pipe extending from a source of waste gas and terminating in a flare pipe outlet end;

(b) a pair of ignition tubes supported along said flare pipe adjacent said outlet end, each ignition tube having an inlet end and an opposite outlet end;

(c) an air distribution enclosure translatably supported along said flare pipe and having each ignition tube communicating therewith, said enclosure having said inlet end of each ignition tube attached thereto, and said enclosure having an extended position toward said flare pipe outlet and a retracted position away from said flare pipe outlet;

(d) a heat shield positioned on said flare pipe at said flare pipe outlet end and shielding portions of said arrangement from heat upon ignition of said waste gas;

(e) a pair of ignition tube extensions extending through said heat shield and positioned thereon for communication respectively with said ignition tubes in said extended position of said enclosure;

(f) a pair of ignition tube guides positioned on said flare pipe and slidably engaged respectively by said ignition tube outlet ends, said guides supporting said ignition tube outlet ends and directing same into registry with said extensions during translation of said enclosure toward said extended position;

(g) a blower communicating with said enclosure and selectively operable to deliver air through said ignition tubes;

(h) fuel delivery means including a fuel line with a valve therein extending through each of said ignition tubes and terminating in a fuel nozzle spaced from said outlet end of said ignition tube, said fuel delivery means selectively delivering fuel through the nozzle in only one of said ignition tubes at a time;

(i) spark generating means including electrode means in each of said ignition tubes, said electrode means defining a spark gap spaced from the fuel nozzle in said ignition tube, said spark generating means being selectively operable to generate a spark only across the spark gap of only the ignition tube in which fuel is being delivered through the fuel nozzle associated therewith;

(j) motor means engaging said enclosure and selectively operable to translate said enclosure between said positions; and (k) control means connected to said motor means, said blower, said fuel delivery means, and said spark generating means and operable to effect for a selected time interval the translation of said enclosure to said extended position, the delivery of air through said ignition tubes, the delivery of fuel through the nozzle of only one ignition tube at a time, and the generation of a spark across the spark gap in said only one ignition tube to ignite pilot flame of said fuel and air to thereby ignite said waste gas.

* * * * *